US007798215B2

(12) United States Patent
Leuthen et al.

(10) Patent No.: US 7,798,215 B2
(45) Date of Patent: Sep. 21, 2010

(54) DEVICE, METHOD AND PROGRAM PRODUCT TO AUTOMATICALLY DETECT AND BREAK GAS LOCKS IN AN ESP

(75) Inventors: John Michael Leuthen, Claremore, OK (US); Brown L. Wilson, Tulsa, OK (US); Jerald R. Rider, Tulsa, OK (US); Bryan D. Schulze, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 71 days.

(21) Appl. No.: 12/144,092

(22) Filed: Jun. 23, 2008

(65) Prior Publication Data

US 2009/0000789 A1 Jan. 1, 2009

Related U.S. Application Data

(60) Provisional application No. 60/946,190, filed on Jun. 26, 2007.

(51) Int. Cl.
*E21B 43/00* (2006.01)
*G05D 7/00* (2006.01)

(52) U.S. Cl. ..... 166/250.15; 166/105; 166/369; 417/443

(58) Field of Classification Search ..... 166/369, 166/105, 250.15; 417/443, 444, 554
See application file for complete search history.

(56) References Cited

U.S. PATENT DOCUMENTS 4,867,242 A * 9/1989 Hart ..... 166/369
5,015,151 A 5/1991 Snyder, Jr. et al.
5,100,288 A 3/1992 Stanislao
5,845,709 A 12/1998 Mack et al.
6,257,354 B1 7/2001 Schrader et al.
6,587,037 B1 7/2003 Besser et al.
6,587,054 B2 7/2003 Besser et al.
6,684,946 B2 2/2004 Gay et al.
6,798,338 B1 9/2004 Layton
2006/0235573 A1 10/2006 Guion
2008/0067116 A1 * 3/2008 Anderson et al. ..... 210/100

FOREIGN PATENT DOCUMENTS

EP 0314249 5/1989

OTHER PUBLICATIONS

David L. Divine, Automatic Pump-Off Control for the Variable Speed Submersible Pump, 55th Annual Fall Technical Conference and Exhibition of the Society of Petroleum Engineers of AIME, Sep. 21-24, 1980. Society of Petroleum Engineers of AIME, Dallas, Texas.

* cited by examiner

*Primary Examiner*—William P Neuder
(74) *Attorney, Agent, or Firm*—Bracewell & Giuliani LLP

(57) ABSTRACT

A device, method, and program product detect and break an occurrence of gas lock in an electrical submersible pump assembly in a well bore based upon surface or downhole data without the need for operator intervention. The system provides the ability to flush the pump and return the system back to production without requiring system shutdown. In addition, the system provides an algorithm for controlling a pump operating speed of the electrical submersible pump assembly to maximize production from the well bore.

6 Claims, 2 Drawing Sheets

DEVICE, METHOD AND PROGRAM PRODUCT TO AUTOMATICALLY DETECT AND BREAK GAS LOCKS IN AN ESP

RELATED APPLICATIONS

This application claims priority to U.S. Provisional Patent Application No. 60/946,190, titled Device, Method and Program Product to Automatically Detect and Break Gas Locks in an ESP, filed on Jun. 26, 2007.

BACKGROUND

1. Field of Invention

The present invention relates, in general, to improving the production efficiency of subterranean wells and, in particular, to a device and method which automatically detects and breaks gas locks in an electrical submersible pump assembly ("ESP") without requiring shutdown of the ESP.

2. Description of the Prior Art

It is well known that gas lock can occur when an ESP ingests sufficient gas so that the ESP can no longer pump fluid to the surface due to, for example, large gas bubbles in the well fluid. Failure to resolve a gas-locked ESP can result in overheating and premature failure. Conventional practice on an ESP is to set a low threshold on motor current to determine when the pump is in gas lock. When this threshold is crossed, the pump is typically stopped and a restart is not attempted until the fluid column in the production tubing has dissipated through the pump. This wait time represents lost production.

It is also known that there are many methods for determining the proper low current threshold and that an unsatisfactory threshold can result in either damage to the motor or nuisance shut downs.

SUMMARY OF INVENTION

In view of the foregoing, embodiments of the present invention provide a device, method and program product for use with an electrical submersible pump assembly which detects and breaks an occurrence of gas lock without the need for operator intervention. In addition, embodiments of the present invention provide for an algorithm for optimizing an operating speed of the electrical submersible pump assembly without need for operator intervention.

Embodiments of the present invention can detect an occurrence of gas lock by monitoring a value associated with the pump motor of the electrical submersible pump, such as, for example, motor torque or motor current. The detection of the occurrence of gas lock can include monitoring an instantaneous value associated with the pump motor of the electrical submersible pump, generating a threshold value based on historical data of values associated with the pump motor of the electrical submersible pump, and comparing the instantaneous value to the threshold value. In a preferred embodiment, the detection of the occurrence of gas lock involves the monitoring of a motor torque and generating a threshold between 65% and 75% of a peak value of the motor torque measured over a predetermined period of between 2 and 5 minutes.

Once the occurrence of gas lock is detected, embodiments of the present invention maintain a pump operating speed. Maintaining a pump operating speed allows the well fluid to remain above the pump in a static condition and allows the gas bubbles in the fluid to rise above the fluid, facilitating a separation of gas and liquid above the pump. After a waiting period of a predetermined duration, the pump operating speed is reduced, thereby allowing the well fluid to fall back through the pump, flushing out the trapped gas. After a predetermined flush period, the pump operating speed is returned to normal. The embodiments of the present invention have the ability to flush the pump and return the system back to production without requiring system shutdown. In a preferred embodiment, the waiting period is between 6 to 7 minutes, the flush period is between 10 and 15 seconds, and the pump operating speed is reduced during the flush period to between 20 and 25 Hz.

In addition, embodiments of the present invention provide for an algorithm for optimizing an operating speed of the electrical submersible pump assembly to maximize production without need for operator intervention. The algorithm increases the pump operating speed by a predetermined increment, e.g. 0.1 Hz, up to a preset maximum pump operating speed, e.g., 62 Hz, when the instantaneous value is continually above the threshold value for a predetermined stabilization period, e.g., 15 minutes. The algorithm decreases the pump operating speed by a predetermined increment, e.g. 0.1 Hz, if the instantaneous value is continually below the threshold value for a predetermined initialization period, e.g., 2 minutes.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
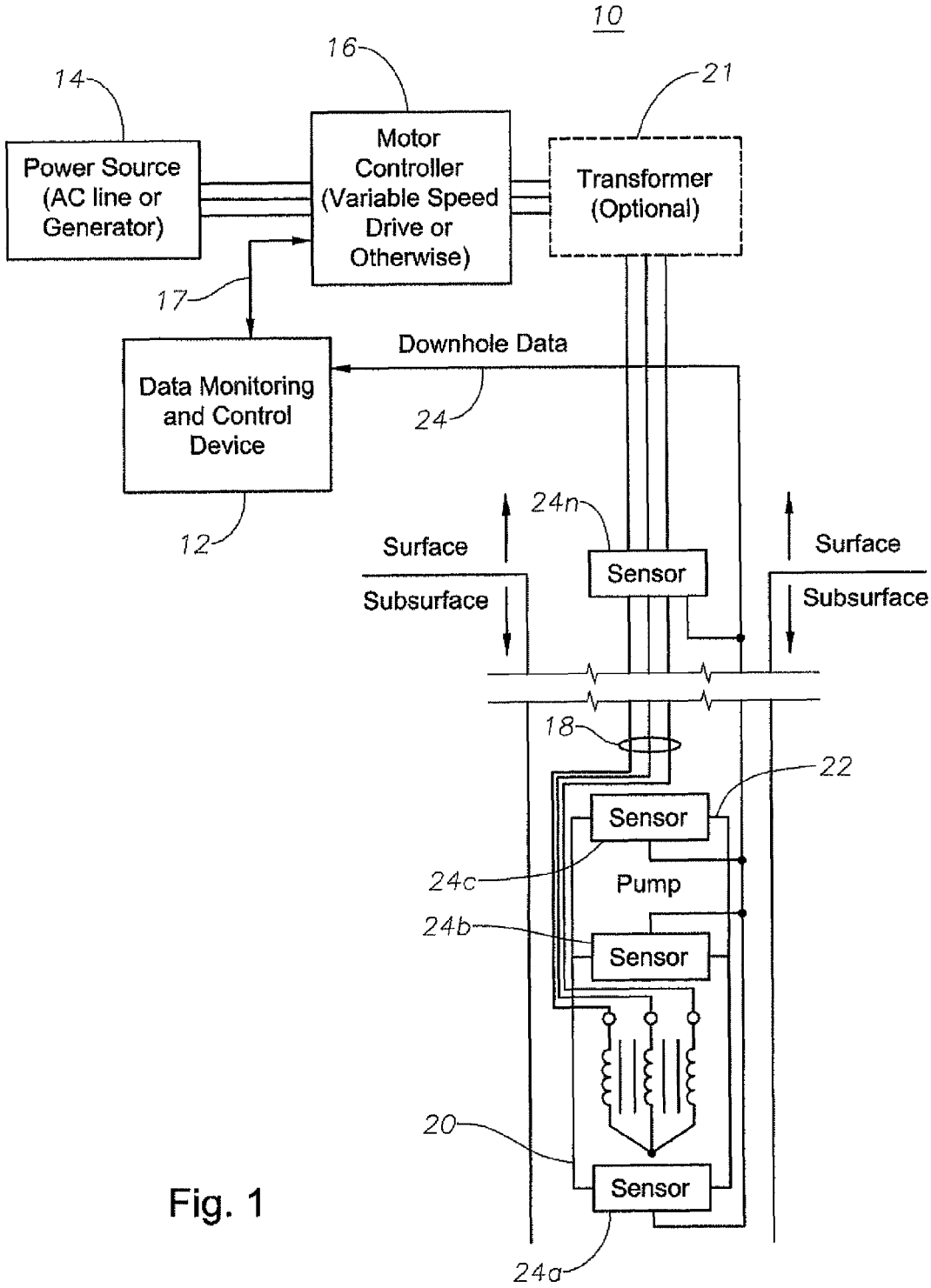
FIG. 1 is a perspective view of a ESP assembly constructed in accordance with an embodiment of the present invention.

FIG. 1 illustrates an exemplary embodiment of a well production system 10 including a data monitoring and control device 12. Well production system 10 includes a power source 14 comprising an alternating current power source such as an electrical power line (electrically coupled to a power utility plant) or a generator electrically coupled to and providing three-phase power to a motor controller 16, which is typically a variable speed drive unit. Motor controller 16 can be any of the well known varieties, such as pulse width modulated variable frequency drives or other known controllers which are capable of varying the speed of production system 10. Both power source 14 and motor controller 16 are located at the surface level of the borehole and are electrically coupled to an induction motor 20 via a three-phase power cable 18. An optional transformer 21 can be electrically coupled between motor controller 16 and induction motor 20 in order to step the voltage up or down as required.

Further referring to the exemplary embodiment of FIG. 1, well production system 10 also includes downhole artificial lift equipment for aiding production, which comprises induction motor 20 and electrical submersible pump 22 ("ESP"), which may be of the type disclosed in U.S. Pat. No. 5,845,709. Motor 20 is electromechanically coupled to and drives pump 22, which induces the flow of gases and liquid up the borehole to the surface for further processing. Three-phase cable 18, motor 20, motor controller 16, and pump 22 form an ESP system.

Pump 22 can be, for example, a multi-stage centrifugal pump having a plurality of rotating impellers stages which increase the pressure level of the well fluids for pumping the fluids to the surface location. The upper end of pump 22 is connected to the lower end of a riser (not shown) for transporting well fluids to a desired location. Typically, a seal section (not shown) is connected to the lower end of pump 22, and a motor 20 is connected to the lower end of the seal section for providing power to pump 22.

Well production system 10 also includes data monitoring and control device 12, typically a surface unit, which may communicate with downhole sensors 24*a*-24*n* via bi-directional link 24. In an exemplary embodiment, sensors 24*a*-24*n* monitor and measure various conditions within the borehole, such as pump discharge pressure, pump intake pressure, tubing surface pressure, vibration, ambient well bore fluid temperature, motor voltage and/or current, motor oil temperature and the like. Although not shown, data monitoring and control device 12 may also include a data acquisition, logging (recording) and control system which would allow device 12 to control the downhole system based upon the downhole measurements received from sensors 24*a*-*n* via bi-directional link 24. Sensors 24*a*-24*n* are located downhole within or proximate to induction motor 20, ESP 22 or any other location within the borehole. Any number of sensors may be utilized as desired.

Further referring to FIG. 1, data monitoring and control device 12 is linked to sensors 24*a*-24*n* via communication link 24 and motor controller 16 via link 17 in order to detect and break gas locks without requiring system shutdown. In the most preferred embodiment, the gas lock detecting and breaking functionality of device 12 is conducted based solely upon surface data, such as current, voltage output and/or torque, received from motor controller 16 via bi-directional link 17. However, in an alternate embodiment, the functionality may also be affected based upon data received from one or more of downhole sensors 24*a*-24*n*.

Data monitoring and control device 12 communicates over well production system 10, using the communication links described herein, on at least a periodic basis utilizing techniques, such as, for example, those disclosed in U.S. Pat. No. 6,587,037, entitled METHOD FOR MULTI-PHASE DATA COMMUNICATIONS AND CONTROL OVER AN ESP POWER CABLE and U.S. Pat. No. 6,798,338, entitled RF COMMUNICATION WITH DOWNHOLE EQUIPMENT. Device 12 is coupled to motor controller 16 via bi-directional link 17 in order to receive measurements such as, for example, amperage, current, voltage and/or frequency regarding the three phase power being transmitted downhole. Such control signals would regulate the operation of the motor and/or pump 22 to optimize production of the well production assembly 10, such as, for example, detecting and breaking gas locks. Moreover, these control signals may be transmitted to some other desired destination for further analysis and/or processing.

Data monitoring and control device 12 controls motor controller 16 by controlling such parameters as on/off, frequency (F), and/or voltages each at one of a plurality of specific frequencies, which effectively varies the operating speed of motor 20. Such control is conducted via link 17. The functions of device 12 may execute within the same hardware as the other components comprising device 12, or each component may operate in a separate hardware element. For example, the data processing, data acquisition/logging and data control functions of the present invention can be achieved via separate components or all combined within the same component.

During production, some wells produce gas along with oil. As such, there is a tendency for the gas to enter the pump assembly 22 along with the well fluid, which can decrease the volume of oil produced or may even lead to a "gas lock." A gas lock is a condition in an ESP assembly in which gas interferes with the proper operation of impellers and other pump components, preventing the pumping of liquid.

Figure 2:
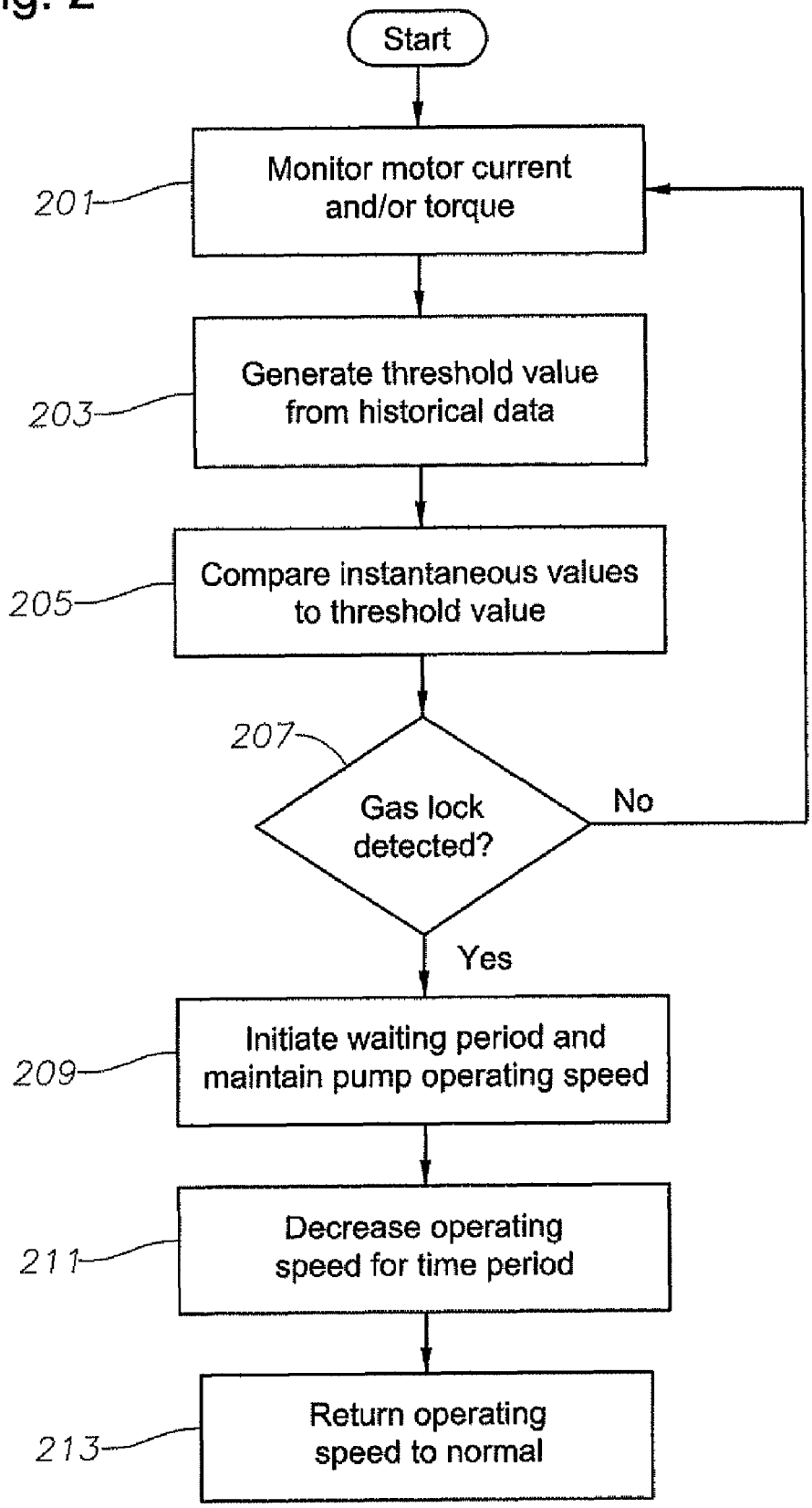
FIG. 2 is a flow chart detailing an algorithm according to an embodiment of the present invention.

Referring to FIG. 2, an exemplary algorithm for detecting and breaking a gas lock will now be described. Although not shown in FIG. 1, data monitoring and control device 12 also comprises a processor and memory which performs the logic, computational, and decision-making functions of the present invention and can take any form as understood by those in the art. The memory can include volatile and nonvolatile memory known to those skilled in the art including, for example, RAM, ROM, and magnetic or optical disks, just to name a few.

At step 201, data monitoring and control device 12 continuously monitors the output current, voltage and/or torque of motor controller 16 via bi-directional link 17 in order to detect and break gas locks in accordance with the present invention. However, in the alternative, output measurements from downhole sensors 24*a*-24*n* may also be monitored. At step 203, data monitoring and control device 12 will generate a threshold value of the motor current and/or torque from historical data. The threshold value can be based on a historical value, such as a long-term average of the motor current or motor torque using a time constant long enough to filter out any short term variations in such measurements. Alternately, the threshold value can be based on another historical value, such as a peak value for given data window. When a gas lock does occur, the motor current or motor torque will typically decrease by 30-50%. To determine a 30% drop in the motor torque and/or current, the threshold value can be generated to be, for example, 70% of a long-term average value. Alternately, the threshold value can be generated to be 65% to 75% of a peak value for a given historical data window, e.g., the last 3 minutes. Thereafter, at step 205, the instantaneous value is continuously compared to the threshold value. In the most preferred embodiment, the motor torque is measured instead of the motor current because the torque is more sensitive to downhole phenomena. If control device 12 does not detect an occurrence of gas lock based on the comparison in step 207, the algorithm loops back to step 201 and begins the process again.

Should data monitoring and control device 12 detect an occurrence of gas lock, control device 12 will proceed to step 209. At this step, control device 12 will instruct motor controller 16 via link 17 to maintain the same operating speed for a predetermined waiting period. In the most preferred embodiment, this waiting period has a length of 6 to 7 minutes, however, other waiting periods, including a waiting period of 3 to 15 minutes, can be programmed based upon design constraints. In an alternative embodiment, the waiting period will be limited, at least in part, by a predetermined maximum pump temperature, which would be communicated to device 12 from downhole sensors 24*a-n* via communication link 24.

Further referring to the exemplary algorithm of FIG. 2, as motor 20 maintains this operating speed at step 209, it produces a somewhat static condition as pump 22 produces just enough head to support the column of fluid in the tubing above, but not enough to pump the fluid upwards to the surface. As a result, the gas bubbles in the fluid directly over the pump begin to rise, while the fluid settles and becomes denser.

At step 211, data monitoring and control device 12 ends the waiting period and decreases the operating frequency to a lower value, such as, for example, 20-25 Hz. The normal operating frequency is typically set at 60 Hz. This decreased operating frequency is maintained for a predetermined period of time, such as, for example, 10-15 seconds. During this time, pump 22 can no longer support the fluid column just above it and, thus, the fluid begins to fall back through pump 22, flushing out the trapped gas. At the end of this low speed period of step 211, device 12 increases the operating frequency of pump 22 back to normal and production begins again at step 213.

Embodiments of the present invention further provide an algorithm for optimizing an operating speed of the electrical submersible pump assembly to maximize production without need for operator intervention. The algorithm increases the pump operating speed by a predetermined increment, e.g., between 0.08 and 0.4 Hz, preferably 0.1 Hz, up to a preset maximum pump operating speed, e.g., 62 Hz, when the instantaneous value is continually above the threshold value for a predetermined stabilization period, e.g., between 10 to 20 minutes, preferably 15 minutes. The algorithm decreases the pump operating speed by a predetermined increment, e.g., between 0.08 and 0.4 Hz, preferably 0.1 Hz, if the instantaneous value is continually below the threshold value for a predetermined initialization period, e.g., between 90 seconds and 3 minutes, preferably 2 minutes. In the absence of gas lock or gas bubbles for a reasonable period of time, the algorithm increases the pump operating speed in a step-wise fashion to maximize production. In the presence of gas bubbles but not true gas lock, the algorithm does not alter the pump operating speed. Gas bubbles, without causing an occurrence of gas lock, can cause a temporary drop in the motor current or motor torque as understood by those skilled in the art. If the algorithm detects an occurrence of gas lock, in which the instantaneous value is continually below the threshold value for a period of time, e.g., 2 minutes, the algorithm lowers the pump operating speed (and the rate of production) by a small increment to better adjust to the level of gas and attempt to prevent further occurrences of gas lock as understood by those skilled in the art.

This invention has significant advantages. It has the ability to reliably detect a gas lock, without operator intervention, based upon surface data and/or downhole data. Also, it has the ability to break a gas lock once detected, without requiring system to be shut down. Data monitoring and control device 12 may take form in various embodiments. It may be part of the hardware located at the well site, included in the software of a programmable ESP controller, variable speed drive, or may be a separate box with its own CPU and memory coupled to such components. Also, control device 12 may even be located across a network as a piece of software code running in a server which bi-directionally communicates with production system 10 to receive surface and/or downhole readings and transmit control signals accordingly.

Embodiments of the present invention can include a method of breaking a gas lock in an electrical submersible pump assembly. The method can include detecting an occurrence of gas lock in a electrical submersible pump assembly by monitoring an instantaneous value associated with the pump motor of the electrical submersible pump assembly, generating a threshold value based on historical data of values associated with the pump motor of the electrical submersible pump assembly, and comparing the instantaneous value to the threshold value to thereby detect the occurrence gas lock in the electrical submersible pump assembly. The method can further include breaking the detected occurrence of gas lock by maintaining a pump operating speed for a first predetermined duration defining a waiting period to facilitate a separation of gas and liquid located above the pump, reducing the pump operating speed to a predetermined value defining a flush value for a second predetermined duration defining a flush period so that the fluid located above the pump falls back through the pump flushing out any trapped gas, and restoring the pump operating speed to the previously maintained pump operating speed.

According to embodiments of the present invention, the generated threshold value based on historical data of values associated with the pump motor of the electrical submersible pump assembly can be between 65% and 75% of a peak instantaneous value measured over a predetermined period of between 2 and 5 minutes, preferably 3 minutes. The substep of comparing the instantaneous value to the threshold value can further include increasing the pump operating speed by a predetermined increment up to a preset maximum pump operating speed if the instantaneous value is continually above the threshold value for a third predetermined duration defining a stabilization period, and decreasing the pump operating speed by a predetermined increment if the instantaneous value is continually below the threshold value for a fourth predetermined duration defining an initialization period.

Embodiments of the present invention include a computer program product, stored on a tangible computer readable medium that is readable by a computer, the computer program product comprising a set of instructions that, when executed by a computer, causes the computer to perform the various operations. The operations can include detecting an occurrence of gas lock in a electrical submersible pump assembly, including (i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value to thereby detect the occurrence gas lock in the electrical submersible pump assembly. The operations can further include breaking the detected occurrence of gas lock, including (i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed.

It is important to note that while embodiments of the present invention have been described in the context of a fully functional system and method embodying the invention, those skilled in the art will appreciate that the mechanism of the present invention and/or aspects thereof are capable of being distributed in the form of a computer readable medium of instructions in a variety of forms for execution on a processor, processors, or the like, and that the present invention applies equally regardless of the particular type of signal bearing media used to actually carry out the distribution. Examples of computer readable media include but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as digital and analog communication links. For example, such media can include both operating instructions and/or instructions related to the system and the method steps described above.

Moreover, it is to be understood that the invention is not limited to the exact details of construction, operation, exact materials, or embodiments shown and described, as modifications and equivalents will be apparent to one skilled in the art. For example, although the present invention has focused on measurements of motor torque and/or current, other measurements could also be used to indicate a gas locked state. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A method of breaking a gas lock in an electrical submersible pump assembly, the method comprising:

(a) detecting an occurrence of gas lock in a electrical submersible pump assembly, the electrical submersible pump assembly comprising an electrical submersible pump located in a well bore, a pump motor located in the well bore and attached to the electrical submersible pump, and a motor controller located at the surface of the well bore and electrically coupled to the pump motor through a three-phase power cable, by the substeps of:

(i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value to thereby detect the occurrence of gas lock in the electrical submersible pump assembly; and (b) breaking the detected occurrence of gas lock by the substeps of:

(i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed, wherein the generated threshold value based on historical data of values associated with the pump motor of the electrical submersible pump assembly is between 65% and 75% of a peak instantaneous value measured over a predetermined period of between 2 and 5 minutes; wherein the first predetermined duration defining the waiting period is between 3 and 15 minutes;

wherein the second predetermined duration defining the flush period is between 10 and 15 seconds; and wherein the predetermined value defining the flush value is between 20 and 25 Hz.

2. A method of breaking a gas lock in an electrical submersible pump assembly, the method comprising:

(a) detecting an occurrence of gas lock in a electrical submersible pump assembly, the electrical submersible pump assembly comprising an electrical submersible pump located in a well bore, a pump motor located in the well bore and attached to the electrical submersible pump, and a motor controller located at the surface of the well bore and electrically coupled to the pump motor through a three-phase power cable, by the substeps of:

(i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value by (A) increasing the pump operating speed by a predetermined increment up to a preset maximum pump operating speed if the instantaneous value is continually above the threshold value for a third predetermined duration defining a stabilization period; and (B) decreasing the pump operating speed by a predetermined increment if the instantaneous value is continually below the threshold value for a fourth predetermined duration defining an initialization period; and (b) breaking the detected occurrence of gas lock by the substeps of:

(i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed.

3. A method of claim 2, wherein the third predetermined duration defining the stabilization period is between 10 and 20 minutes; wherein the predetermined increment is between 0.08 and 0.4 Hz; and wherein the fourth predetermined duration defining the initialization period is between 90 seconds and 3 minutes.

4. A computer program product, stored on a tangible computer readable medium that is readable by a computer, the computer program product comprising a set of instructions that, when executed by a computer, causes the computer to perform operations comprising:

(a) detecting an occurrence of gas lock in a electrical submersible pump assembly, the electrical submersible pump assembly comprising an electrical submersible pump located in a well bore, a pump motor located in the well bore and attached to the electrical submersible pump, and a motor controller located at the surface of the well bore and electrically coupled to the pump motor through a three-phase power cable, comprising:

(i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value to thereby detect the occurrence of gas lock in the electrical submersible pump assembly; and (b) breaking the detected occurrence of gas lock, comprising:

(i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed, wherein the generated threshold value based on historical data of values associated with the pump motor of the electrical submersible pump assembly is between 65% and 75% of a peak instantaneous value measured over a predetermined period of between 2 and 5 minutes; wherein the first predetermined duration defining the waiting period is between 3 and 15 minutes; wherein the second predetermined duration defining the flush period is between 10 and 15 seconds; and wherein the predetermined value defining the flush value is between 20 and 25 Hz.

5. A computer program product, stored on a tangible computer readable medium that is readable by a computer, the computer program product comprising a set of instructions that, when executed by a computer, causes the computer to perforin operations comprising:

(a) detecting an occurrence of gas lock in a electrical submersible pump assembly, the electrical submersible pump assembly comprising an electrical submersible pump located in a well bore, a pump motor located in the well bore and attached to the electrical submersible pump, and a motor controller located at the surface of the well bore and electrically coupled to the pump motor through a three-phase power cable, comprising:

(i) monitoring an instantaneous value associated with the pump motor of the electrical submersible pump assembly, (ii) generating a threshold value based on historical data of values associated with the pump motor of the electrical submersible pump assembly, and (iii) comparing the instantaneous value to the threshold value to thereby detect the occurrence of gas lock in the electrical submersible pump assembly; and (b) breaking the detected occurrence of gas lock, comprising:

(i) maintaining a pump operating speed for a first predetermined duration defining a waiting period to facilitate a separation of gas and liquid located above the pump, (ii) reducing the pump operating speed to a predetermined value defining a flush value for a second predetermined duration defining a flush period so that the fluid located above the pump falls back through the pump flushing out any trapped gas, and (iii) restoring the pump operating speed to the previously maintained pump operating speed, wherein the operation of comparing the instantaneous value to the threshold value further comprises:

increasing the pump operating speed by a predetermined increment up to a preset maximum pump operating speed if the instantaneous value is continually above the threshold value for a third predetermined duration defining a stabilization period; and decreasing the pump operating speed by a predetermined increment if the instantaneous value is continually below the threshold value for a fourth predetermined duration defining an initialization period.

6. A computer program product of claim 5, wherein the third predetermined duration defining the stabilization period is between 10 and 20 minutes; wherein the predetermined increment is between 0.08 and 0.4 Hz; and wherein the fourth predetermined duration defining the initialization period is between 90 seconds and 3 minutes.

* * * * *